US009075331B2

(12) United States Patent
Hashimoto et al.

(10) Patent No.: US 9,075,331 B2
(45) Date of Patent: Jul. 7, 2015

(54) IMAGE FORMING APPARATUS

(71) Applicants: Junichi Hashimoto, Toyohashi (JP); Takashi Shimizu, Nagoya (JP)

(72) Inventors: Junichi Hashimoto, Toyohashi (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 83 days.

(21) Appl. No.: 13/628,493

(22) Filed: Sep. 27, 2012

(65) Prior Publication Data

US 2013/0084099 A1 Apr. 4, 2013

(30) Foreign Application Priority Data

Sep. 30, 2011 (JP) ..... 2011-216861

(51) Int. Cl.

| | |
|---|---|
| ***G03G 15/00*** | (2006.01) |
| ***G03G 15/01*** | (2006.01) |
| ***G03G 21/18*** | (2006.01) |
| ***G03G 21/20*** | (2006.01) |

(52) U.S. Cl.

CPC ..... *G03G 15/0194* (2013.01); *G03G 21/1853* (2013.01); *G03G 21/206* (2013.01); *G03G 2215/0141* (2013.01); *G03G 2221/1684* (2013.01)

(58) Field of Classification Search

CPC ..... G03G 15/0886; G03G 15/0834; G03G 15/0844; G03G 15/0848; G03G 21/105; G03G 21/206; G03G 2215/0135; G03G 2215/0685

See application file for complete search history.

(56) References Cited

U.S. PATENT DOCUMENTS

| | | | | |
|---|---|---|---|---|
| 6,892,042 | B2 | 5/2005 | Jang et al. | |
| 7,400,842 | B2 * | 7/2008 | Takehara et al. | 399/92 |
| 7,778,569 | B2 | 8/2010 | Igarashi | |
| 7,877,037 | B2 | 1/2011 | Igarashi | |
| 8,014,696 | B2 | 9/2011 | Igarashi | |
| 8,041,255 | B2 | 10/2011 | Igarashi | |
| 2003/0059233 | A1 | 3/2003 | Jang et al. | |
| 2006/0024083 | A1 * | 2/2006 | Hori et al. | 399/93 |
| 2007/0146739 | A1 | 6/2007 | Igarashi | |
| 2008/0025749 | A1 | 1/2008 | Igarashi | |
| 2010/0266311 | A1 * | 10/2010 | Igarashi | 399/110 |

(Continued)

FOREIGN PATENT DOCUMENTS

| | | | |
|---|---|---|---|
| JP | 2003148503 | A | 5/2003 |
| JP | 2003186348 | A | 7/2003 |
| JP | 2007178608 | A | 7/2007 |

(Continued)

*Primary Examiner* — Roy Y Yi
(74) *Attorney, Agent, or Firm* — Banner & Witcoff, Ltd.

(57) ABSTRACT

An image forming apparatus which may include an apparatus main body and a module unit. The module unit may include a communication member having an opening that allows communication between inside and outside of the module unit and a unit-side positioning portion located adjacent to the opening of the communication member. Further, the apparatus main body may include a ventilation member having an opening located so as to oppose the opening of the communication member. Further, the apparatus main body may include a main body-side positioning portion located adjacent to an opening of the ventilation member. Also, the apparatus main body may include an urging member that is configured to urge the module unit so as to bring the unit-side positioning portion into contact with the main body-side positioning portion.

24 Claims, 10 Drawing Sheets

(56) References Cited

U.S. PATENT DOCUMENTS

| | | | | |
|---|---|---|---|---|
| 2011/0026963 | A1 | 2/2011 | Kondo | |
| 2011/0097101 | A1 | 4/2011 | Igarashi | |
| 2011/0142481 | A1* | 6/2011 | Kwak | 399/92 |
| 2011/0182615 | A1* | 7/2011 | Morishita | 399/111 |

FOREIGN PATENT DOCUMENTS

| | | | |
|---|---|---|---|
| JP | 2008032916 | A | 2/2008 |
| JP | 2011022608 | A | 2/2011 |
| JP | 2011033880 | A | 2/2011 |

* cited by examiner

IMAGE FORMING APPARATUS

CROSS-REFERENCE TO RELATED APPLICATION

This application claims priority to JP 2011-216861, filed Sep. 30, 2011, whose contents are expressly incorporated herein by reference.

TECHNICAL FIELD

Aspects of the disclosure relates to an image forming apparatus that includes a module unit including components for forming an image on a recording sheet and movable with respect to the main body of the apparatus.

BACKGROUND

An image forming apparatus based on electrophotography is known that includes a drawer (module unit) removably attached to the apparatus main body, a drawer-side duct provided on the drawer so as to supply air into the drawer, and an apparatus-side duct provided on the apparatus main body so as to supply air to the drawer-side duct. According to this apparatus, the apparatus-side duct is supported by the apparatus main body so as to move between a position close to the drawer-side duct and a position away therefrom, so that the apparatus-side duct can be located close to the drawer-side duct to thereby reduce the gap between the joint portions of the ducts.

However, such a configuration makes the structure around the apparatus-side duct of the apparatus main body complicated.

SUMMARY

Aspects of the disclosure relate to an image forming apparatus which may include an apparatus main body and a module unit. The module unit may include components for forming an image on a recording sheet, and be movable along a predetermined moving direction between an inner position inside the apparatus main body and an outer position wherein at least a portion of the module unit is outside of the apparatus main body. The module unit may include a communication member having an opening that allows communication between inside and outside of the module unit and a unit-side positioning portion that is located adjacent to the opening of the communication member. Further, the apparatus main body may include a ventilation member having an opening, the opening of the ventilation member located so as to oppose the opening of the communication member of the module unit located at the inner position. Further, the ventilation member may form a flow path of air together with the communication member. Further, the apparatus main body may include a main body-side positioning portion located adjacent to an opening of the ventilation member. Also, the apparatus main body may include an urging member that is configured to urge the module unit so as to bring the unit-side positioning portion into contact with the main body-side positioning portion, the urging member being provided between the module unit and the apparatus main body when the module unit is located at the inner position.

Further aspects of the disclosure relate to an image forming apparatus which may include an apparatus main body and a module unit. The module unit may be movable along a first direction between an inner position inside the apparatus main body and an outer position wherein at least a portion of the module unit is outside of the apparatus main body. The module unit may include a first side and a second side that is opposite side of the first side in a second direction perpendicular to the first direction. Further, the module unit may include a communication member having a communication portion that is located at the first side of the module unit and allows communication between inside and outside of the module unit. The module unit may include a unit-side positioning portion located at the first side of the module unit. The apparatus main body may include a ventilation member having a ventilation portion, the ventilation portion located so as to oppose the communication portion and to communicate with the communication portion when module unit is located at the inner position. The ventilation member may form a flow path of air together with the communication portion. Further, the apparatus main body may include a main body-side positioning portion that is located to oppose the unit side positioning portion of module unit located at the inner position and an urging member that is configured to urge the module unit so as to bring the unit-side positioning portion into contact with the main body-side positioning portion. The urging member may be provided between the module unit and the apparatus main body when the module unit is located at the inner position.

Further aspects of the disclosure relate to an image forming apparatus which may include an apparatus main body and a module unit. The module unit may include components for forming an image on a recording sheet and be movable between an inner position inside the apparatus main body and an outer position outer than the inner position, along a predetermined moving direction. Further, the module unit may include a module unit body configured to receive a cartridge, and which includes a communication member having an opening that allows communication between inside and outside of the module unit and a unit-side positioning portion that is located adjacent to the opening of the communication member. The apparatus main body may include a ventilation member having an opening, the opening of the ventilation member located so as to oppose the opening of the communication member of the module unit located at the inner position, the ventilation member forming a flow path of air together with the communication member. Further, the apparatus main body may include a main body-side positioning portion located adjacent to an opening of the ventilation member, and an urging member that is configured to urge the module unit body so as to bring the unit-side positioning portion into contact with the main body-side positioning portion. The urging member may be provided between the module unit and the apparatus main body when the module unit is located at the inner position.

DETAILED DESCRIPTION

Figure 1:
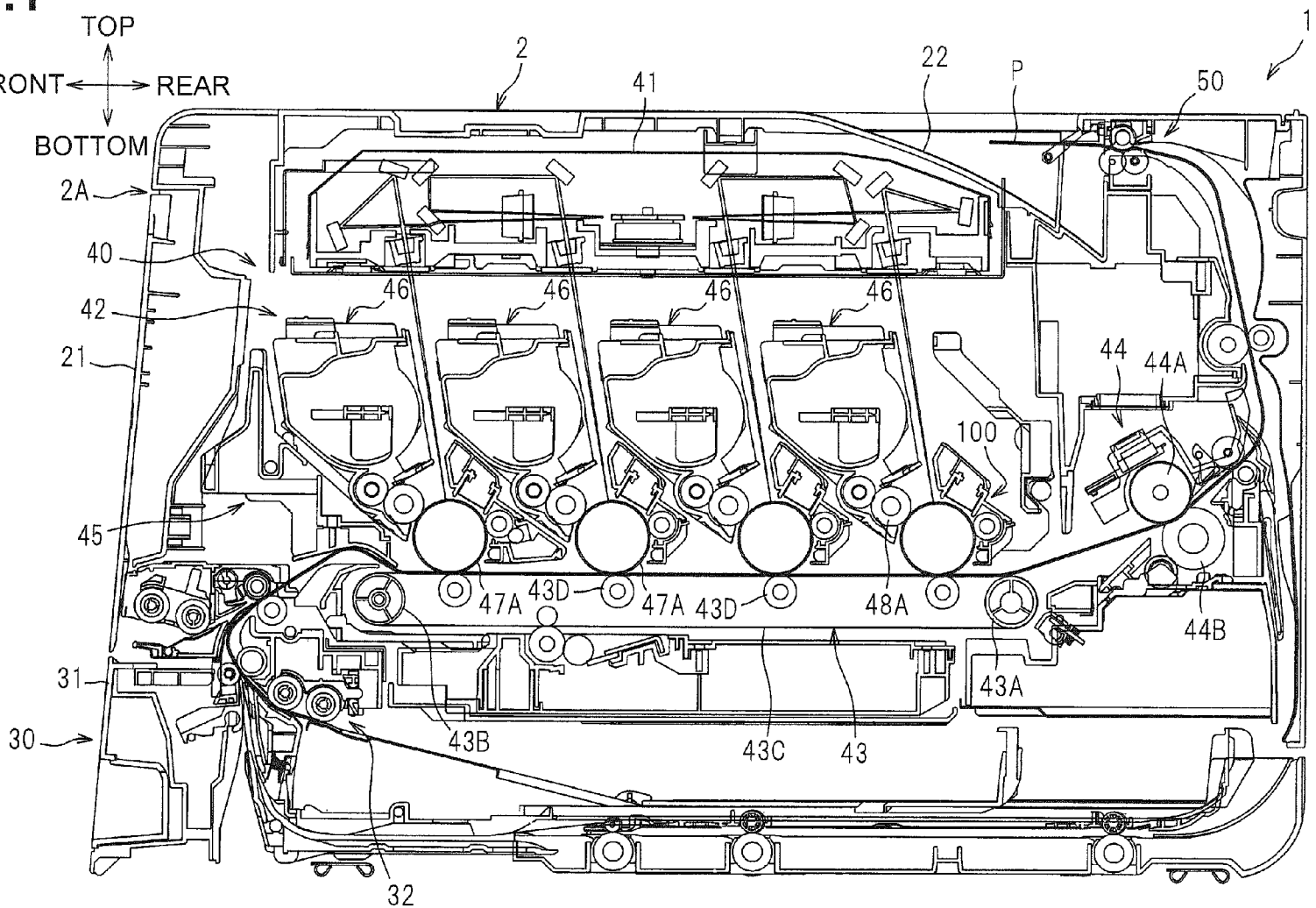
FIG. 1 is a cross-sectional view of a color laser printer according to an embodiment of the present invention.

Hereafter, an embodiment of the present invention will be described in detail referring to the drawings. In the following passages, a general configuration of a color laser printer exemplifying the image forming apparatus will be first described, and then the feature of the present invention will be described in detail.

In the following description, directions will be specified on the basis of the viewpoint of the user of the color laser printer. Specifically, in FIG. 1, the left side on the sheet will be referred to as front and the right side on the sheet as rear. A depthwise direction with respect to the sheet will be referred to as left-right direction, a deeper position being the left and a shallower position being the right. In addition, a vertical direction on the sheet will be referred to as up and downward direction.

As shown in FIG. 1, the color laser printer 1 includes a paper feed unit 30 that supplies a paper sheet P exemplifying the recording sheet to inside an apparatus main body 2, an image forming unit 40 that forms an image on the paper sheet P supplied from the paper feed unit 30, and a paper delivery unit 50 that discharges the paper sheet P outputted from the image forming unit 40, out of the apparatus main body 2.

The apparatus main body 2 includes an opening 2A formed in a front wall for attaching and detaching a drawer 45 exemplifying the module unit to be subsequently described, and a front cover 21 pivotally attached to the front wall so as to open and close the opening 2A.

The paper feed unit 30 includes a paper feed tray 31 removably mounted in the apparatus main body 2, and a paper supply mechanism 32 that transports the paper sheet P from the paper feed tray 31 to the image forming unit 40.

The image forming unit 40 includes a scanner unit 41, a processing unit 42, a transfer unit 43, and a fixing unit 44.

The scanner unit 41 includes a laser emitter (not shown), a polygon mirror, a plurality of lenses and a reflecting mirror, which are not given a reference numeral. In the scanner unit 41, laser beams respectively corresponding to cyan, magenta, yellow, and black are emitted toward a photo conductor 47A exemplifying the photoreceptor.

The processing unit 42 includes the drawer 45 located between the scanner unit 41 and the transfer unit 43 and removably mounted in the apparatus main body 2. The drawer 45 is movable, when the front cover 21 is opened, between an inner position inside the apparatus main body 2 and an outer position located outer than the inner position (for example, a position outside the apparatus main body 2) in the front-back direction (predetermined moving direction).

The drawer 45 is formed of sidewalls provided on the front, back, left, and right sides thereof in a rectangular tubular shape, and includes four (a plurality of) processing cartridges 46 aligned in a direction in which the paper sheet P is transported (hereinafter, transport direction).

Figure 2:
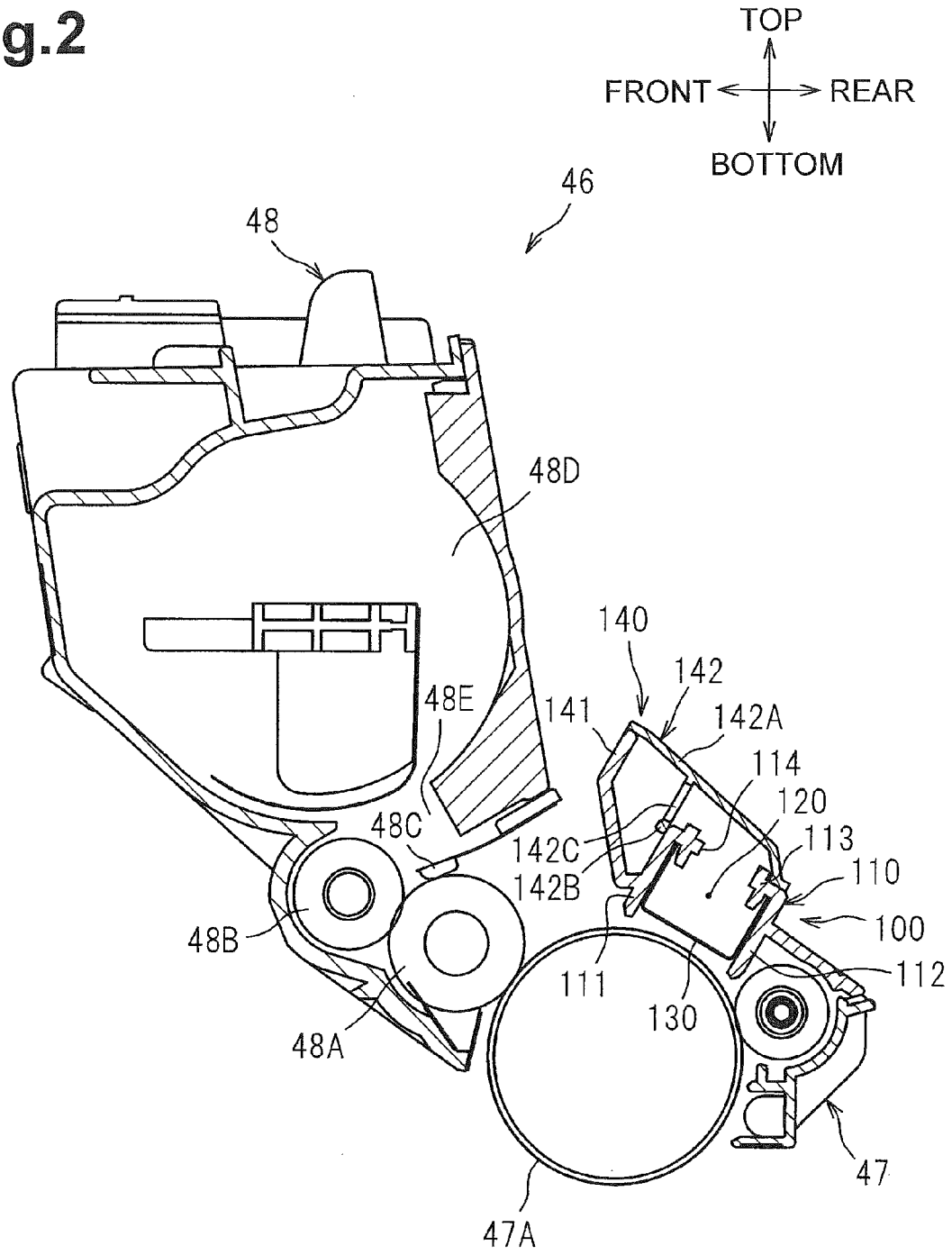
FIG. 2 is a cross-sectional view of a processing cartridge.

The processing cartridges 46 each include, as shown in FIG. 2, a drum subunit 47 located at a lower position, and a developing cartridge 48 located above the drum sub unit 47.

The drum sub unit 47 is supported by a side plate 45E provided on a left and right pair of sidewalls 45A (see FIG. 3) of the drawer 45, and includes a charger 100 and so on. The photo conductor 47A exemplifying the photoreceptor is rotatably supported by the side plate 45E. The structure of the charger 100 will be subsequently described in detail.

The developing cartridge 48 is configured so as to supply a toner, exemplifying the developing agent to the photo conductor 47A, and removably mounted on the left and right pair of sidewalls 45A of the drawer 45. The developing cartridge 48 includes a developing roller 48A, a supply roller 48B, a thickness delimiting blade 48C exemplifying the slide-contact member, a toner chamber 48D and a developing chamber 48E. Nonmagnetic mono-component toners (developing agent) of cyan, magenta, yellow, and black are provided in the each toner chamber 48D, respectively. In addition, the developing roller 48A and the thickness delimiting blade 48C are provided in the developing chamber 48E.

As shown in FIG. 1, in the processing unit 42 the surface of the photo conductor 47A charged by the charger 100 is exposed to the laser beam emitted from the scanner unit 41, so that the potential of the exposed portion drops and a static latent image based on image data is formed on the photo conductor 47A. The toner in the toner chamber 48D is supplied to the developing roller 48A by the supply roller 48B, and the toner is frictionally charged between the supply roller 48B and the developing roller 48A.

The toner supplied to the developing roller 48A is carried by the developing roller 48A in a thin layer of a predetermined thickness adjusted by the thickness delimiting blade 48C disposed in slide-contact with the developing roller 48A. Thereafter the toner on the developing roller 48A is supplied onto the static latent image on the photo conductor 47A, so that a toner image is carried by the photo conductor 47A.

The transfer unit 43 includes a driving roller 43A, a slave roller 43B, a conveyor belt 43C, and a transfer roller 43D. On the transfer unit 43, when the paper sheet P transported on the conveyor belt 43C is fed between the photo conductor 47A and the transfer roller 43D, the toner image on the photo conductor 47A is transferred onto the paper sheet P.

The fixing unit 44 includes a heating roller 44A and a pressure roller 44B. In the fixing unit 44, the paper sheet P is delivered through between the heating roller 44A and the pressure roller 44B after being pinched therebetween, so that the toner image on the paper sheet P is thermally fixed.

The paper delivery unit 50 includes a plurality of transport rollers (numeral not given), through which the paper sheet P delivered from the fixing unit 44 is transported to a paper output tray 22 located at an upper position.

Structure for Feeding Air into Charger

Hereunder, a structure for feeding air into the charger 100, which is a distinctive feature of the present invention, will be descried in detail. The charger 100 utilizes corona discharge and, as shown in FIG. 2, includes a frame 110, a discharge wire 120, and a grid electrode 130.

The frame 110 constitutes an upper portion of the case of the drum sub unit 47, and includes a front wall 111 and a rear wall 112 located on the respective sides of the grid electrode 130 generally in the front-back direction, and an upper wall 113 extending so as to connect the respective upper edge of the front wall 111 and the rear wall 112. The upper wall 113 includes a through hole 114 formed so as to penetrate therethrough in the up-down direction, through which air outside the frame 110 can be introduced thereinto.

The discharge wire 120 generates ion by application of a voltage, and is disposed so as to oppose the through hole 114 and to extend in an axial direction of the photo conductor 47A. The respective end portions of the discharge wire 120 are supported by the left and right sidewalls of the frame 110.

The grid electrode 130 provided to regulate the potential of the ion flowing from the discharge wire 120 to the surface of the photo conductor 47A, and formed in a shape having a C-shaped cross-section including a plurality of grid holes (numeral not given) formed on the bottom wall thereof.

A drawer-side duct 140 exemplifying the communication member communicating with the inside of the frame 110 is provided in the frame 110 as an integral part thereof. The drawer-side duct 140 includes a duct portion 141 integrally formed with the front wall 111 of the frame 110, and a cover member 142 that covers the duct portion 141 and the upper wall 113 of the frame 110.

The duct portion 141 is formed so as to extend from a lower portion of the front wall 111 with a plurality of bent portions, so as to form a generally U-shaped cross-section together with the front wall 111. The duct portion 141 extends in the left-right direction (orthogonal to the moving direction of the drawer 45), and constitutes a tubular shape by having its upper opening covered with the cover member 142.

The cover member 142 includes a main body portion 142A covering the duct portion 141 and the upper wall 113 of the frame 110, and a partition portion 142B extending from a generally central portion of the main body portion 142A to the upper end portion of the front wall 111 so as to contact the upper end portion. The partition portion 142B includes a ventilation hole 142C that allows communication between the inside of the duct portion 141 and a space above the upper wall 113 of the frame 110.

Figure 3:
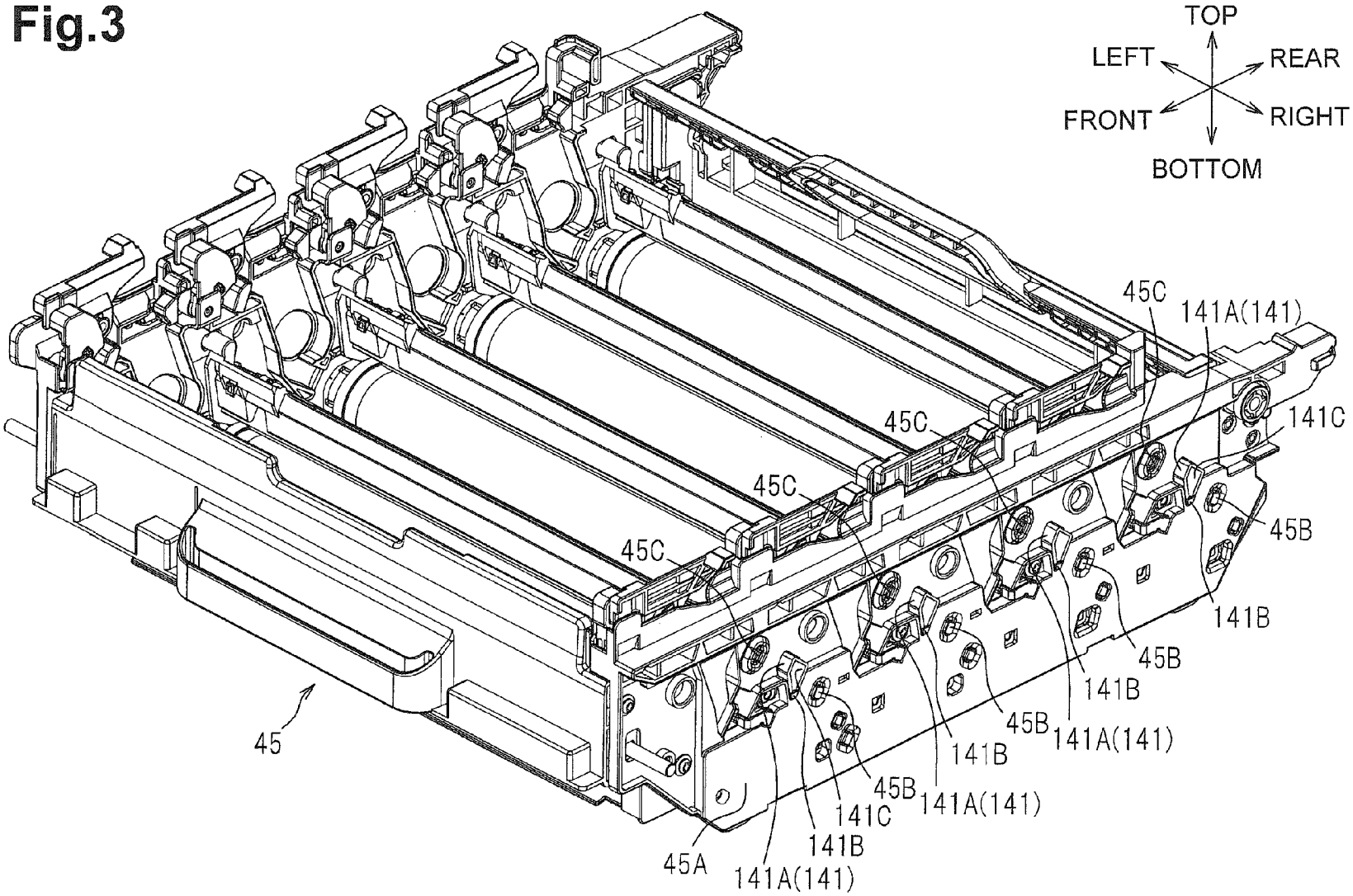
FIG. 3 is a perspective view of a drawer viewed from the right.

As shown in FIG. 3, the right side end portion 141A of the duct portion 141 is formed in a tubular shape and sticks out in the left-right direction from the sidewall 45A of the drawer 45. With the drawer-side duct 140 thus configured, air outside the sidewall 45A of the drawer 45 in the left-right direction can be introduced into the sidewall 45A, more specifically into the charger 100.

Further, a drawer-side positioning portion 141B exemplifying the unit-side positioning portion is formed on the facet of the right side end portion 141A of the duct portion 141. Specifically, the drawer-side positioning portion 141B is located adjacent to a lower portion of the opening 141C of the duct portion 141.

Figure 4:
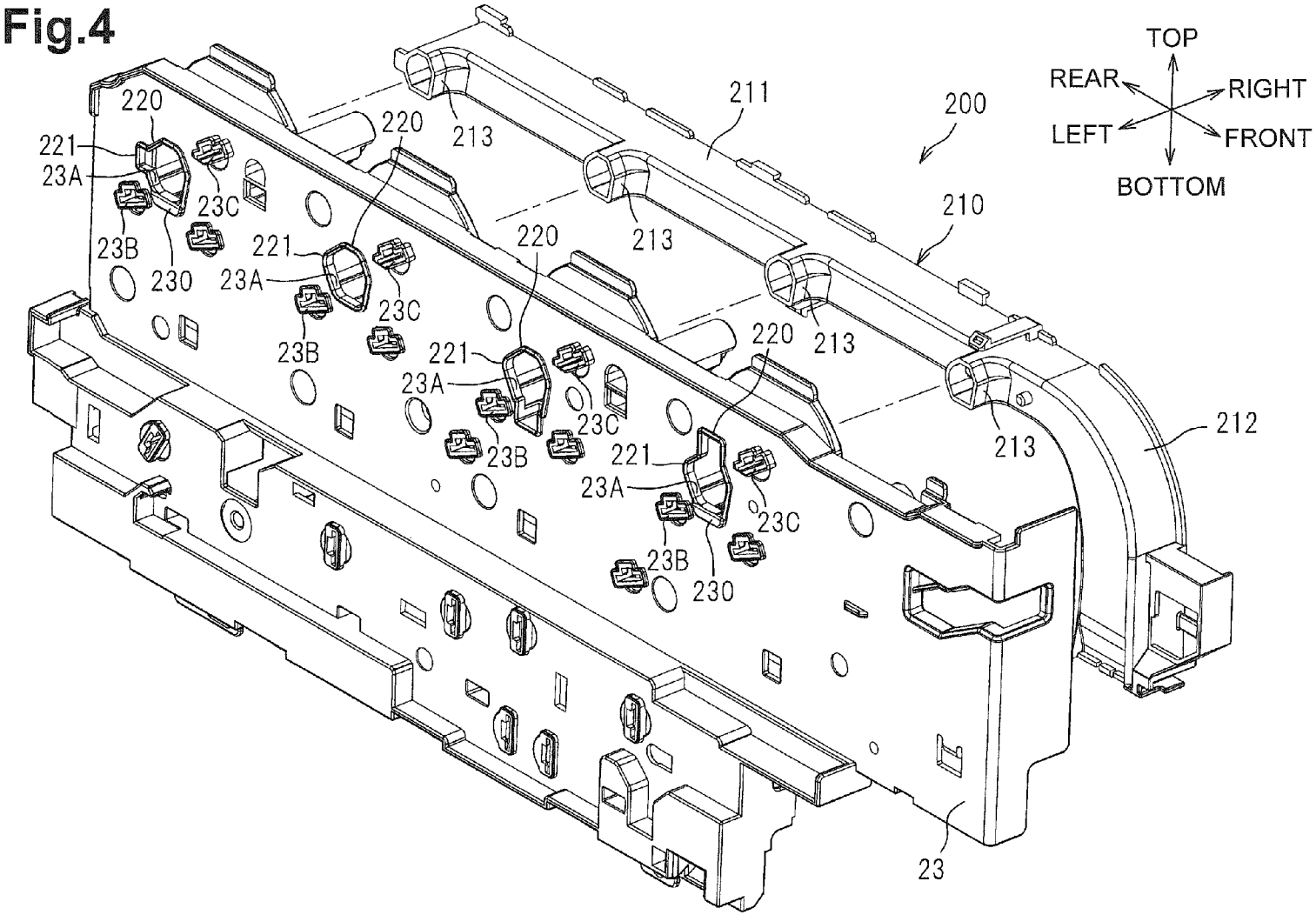
FIG. 4 is an exploded perspective view of a sidewall of an apparatus main body on the right and an apparatus-side duct.

In contrast, as shown in FIG. 4, the apparatus main body 2 includes therein an apparatus-side duct 200 exemplifying the ventilation member for introducing air into the drawer-side duct 140. The apparatus-side duct 200 includes a duct member 210 and four duct ribs 220 formed on the right sidewall 23 of the apparatus main body 2.

The duct member 210 is a tubular member constituting a flow path for air, and includes a front-back linear portion 211 extending in the front-back direction and a bent portion 212 bent downward in an arcuate shape from the front end portion of the front-back linear portion 211. The front-back linear portion 211 includes four tubular joint portions 213 protruding toward the respective duct ribs 220 from the respectively corresponding positions. The joint portions 213 are respectively fitted in four joint orifices 23A formed in the sidewall 23 of the apparatus main body 2.

The bent portion 212 includes an orifice (not shown) formed in a lower portion so as to open outward in the left-right direction. When air is introduced to this orifice by a fan (not shown), the air is made to flow through the bent portion 212 and the front-back linear portion 211, and then to inside in the left-right direction through the respective joint portions 213.

The duct ribs 220 each protrude inward in the left-right direction from the periphery of the joint orifice 23A in the sidewall 23 of the apparatus main body 2, so as to surround the joint orifice 23A. In addition, as shown in FIG. 5, the duct rib 220 is disposed such that the opening 221 opposes the opening 141C of the respective duct portions 141 of the drawer 45 located at the inner position, in the left-right direction.

Such a configuration allows air discharged through the joint portion 213 fitted to the joint orifice 23A to flow into the drawer-side duct 140 on the inner side in the left-right direction, through the duct rib 220. In other words, the apparatus-side duct 200 constitutes the flow path for the air together with the drawer-side duct 140.

As shown in FIG. 4, a main body-side positioning portion 230 is integrally formed with the duct rib 220, at the lower end portion of the headmost and the rearmost ones of the four duct ribs 220, respectively. More specifically, the main body-side positioning portion 230 is formed adjacent to the lower end portion of the opening 221 of the duct rib 220.

Figure 5:
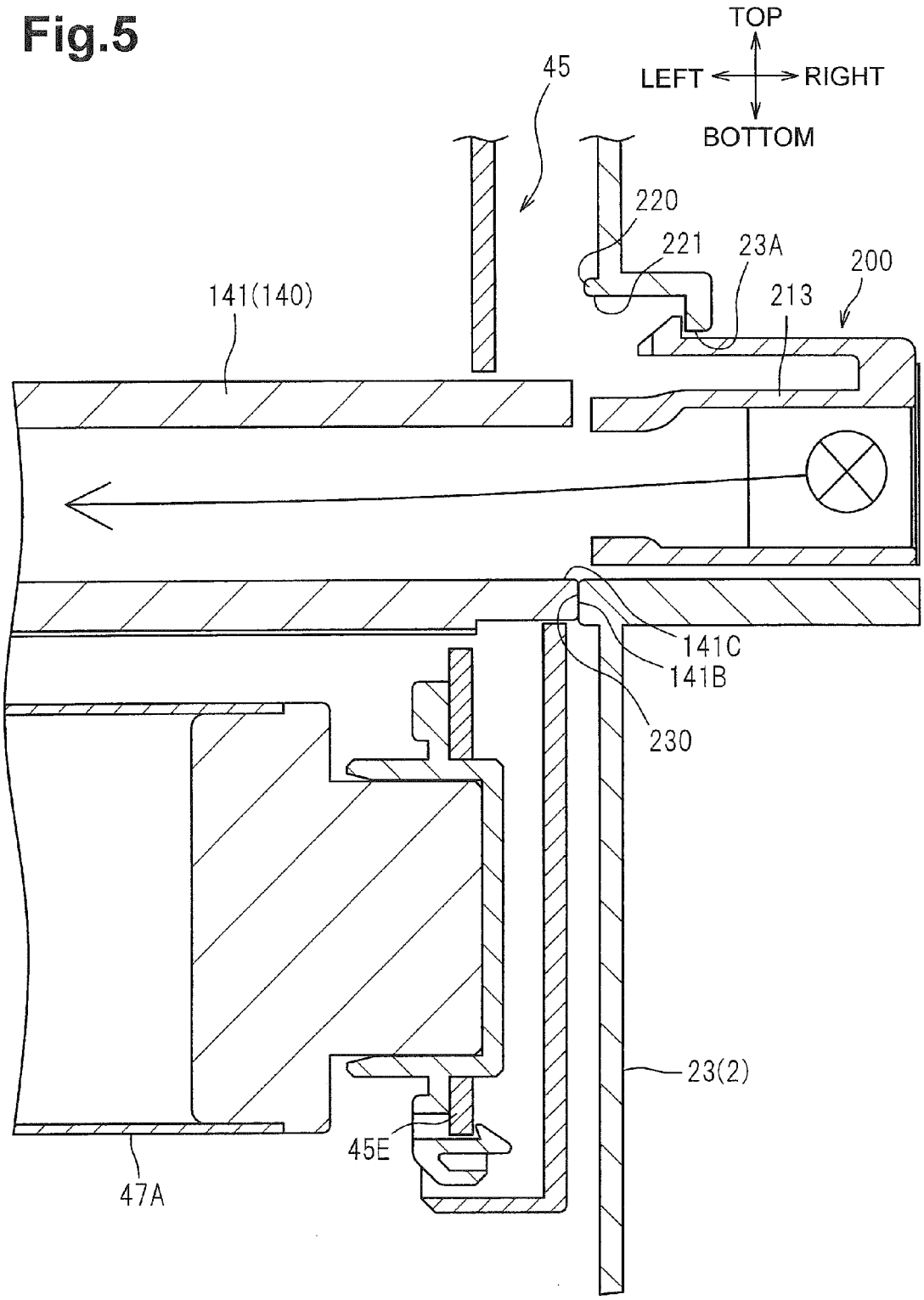
FIG. 5 is a cross-sectional view of a drawer-side duct and an apparatus-side duct connected to each other.

Here, when the drawer 45 is urged toward the right by a driving force transmission unit 60 exemplifying the urging member to be subsequently described, the drawer-side positioning portion 141B is made to contact the main body-side positioning portion 230 as shown in FIG. 5. The drawer 45 can thus be positioned with respect to the sidewall 23 of the apparatus main body 2 in the left-right direction, and therefore the photo conductor 47A, the charger 100, and the developing cartridge 48 supported by the drawer 45 can be positioned with respect to the apparatus main body 2.

In addition, since the drawer-side duct 140 and the apparatus-side duct 200 are respectively provided adjacent to the positioning portions 141B, 230 contributing to the positioning of the drawer 45, the gap between the drawer-side duct 140 and the apparatus-side duct 200 can be accurately controlled, which allows the gap between the joint portions of the ducts 140, 200 to be made smaller. Further, reducing thus the gap between the joint portions allows a sufficient amount of air to be introduced into the charger 100, so that the ionic wind can effectively flow and resultantly the charging performance can be improved.

Furthermore, the drawer 45 movable with respect to the apparatus main body 2, in other words, the drawer 45 installed with a slight play for moving in the left-right direction with respect to the apparatus main body 2, is urged by the driving force transmission unit 60 to be subsequently described so that the ducts 140, 200 come close to each other, which eliminates the need to configure the duct on the side of the apparatus main body so as to move, thereby allows the structure to be simplified.

According to this embodiment, the main body-side positioning portion 230 is provided to the headmost and the rearmost ones of the four duct ribs 220, so that the main body-side positioning portion 230 contacts the headmost and the rearmost ones of the drawer-side positioning portions 141B. Such a configuration effectively suppresses the drawer 45 from tilting.

Although the drawer-side positioning portion 141B is provided to all the four drawer-side ducts 140 according to this embodiment, the present invention is not limited to this configuration but the same number of drawer-side positioning portions as the main body-side positioning portions may be provided at the respective positions corresponding to the main body-side positioning portions. It is to be noted, however, that providing the drawer-side positioning portion 141B to all the four drawer-side ducts 140 as in this embodiment allows common use of the components constituting the drawer-side duct 140.

The photo conductor 47A is positioned with respect to the drawer 45 in the left-right direction (axial direction). Accordingly, when the drawer-side positioning portion 141B and the main body-side positioning portion 230 contact each other so that the drawer 45 is positioned with respect to the apparatus main body 2, the photo conductor 47A is also positioned with respect to the apparatus main body 2 through the drawer 45, which enables the photo conductor 47A to be accurately positioned with respect to the apparatus main body 2.

Figure 6A:
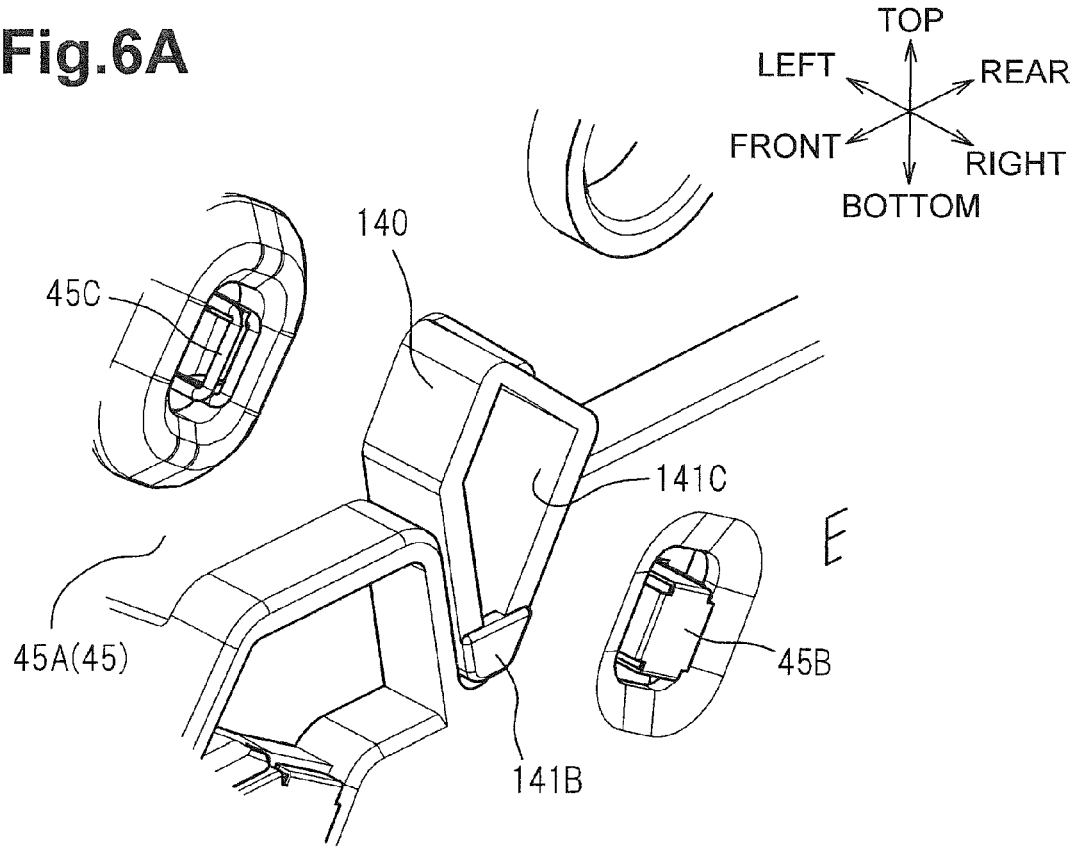
FIGS. 6A and 6B are enlarged perspective views showing a structure around a drawer-side positioning portion and a structure around a main body-side positioning portion, respectively.

Referring to FIG. 6A, the drawer-side positioning portion 141B is formed so as to protrude from a part of the periphery of the opening 141C of the drawer-side duct 140 toward the main body-side positioning portion 230. Such a configuration contributes to improving the positioning accuracy of the drawer-side duct 140 with respect to the apparatus-side duct 200, and resultantly the positioning accuracy of the drawer 45 with respect to the apparatus main body 2, compared with a configuration in which, for example, the entirety of the periphery of the opening of the drawer-side duct is formed as the positioning portion.

Figure 6B:
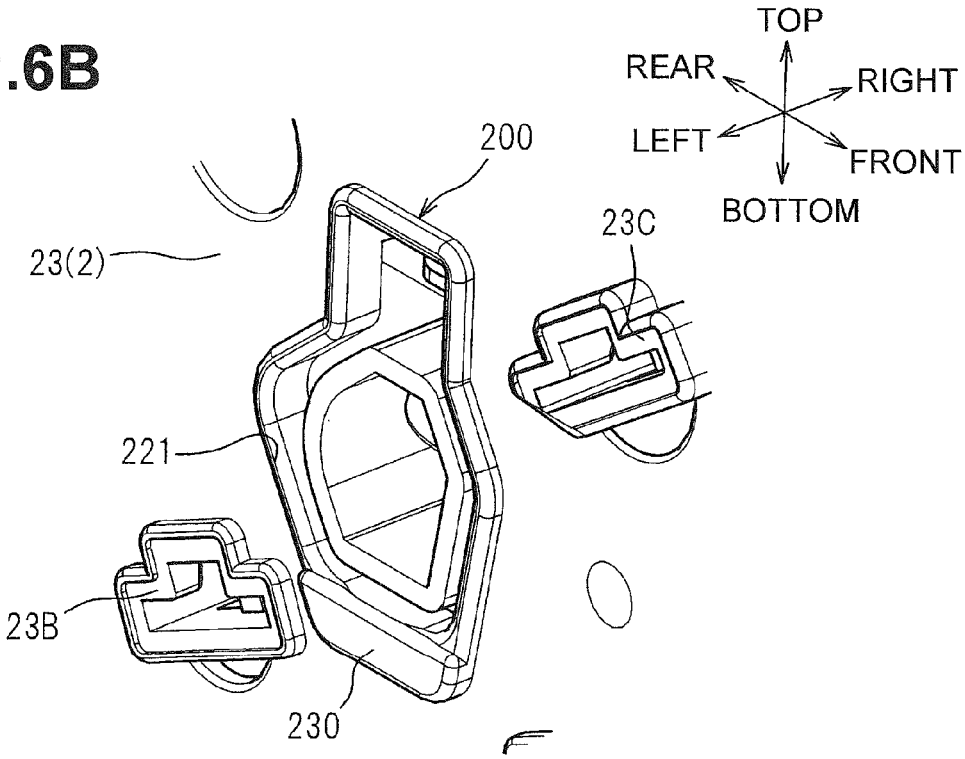

Likewise, as shown in FIG. 6B, the main body-side positioning portion 230 is also formed so as to protrude from a part of the periphery of the opening 221 of the apparatus-side duct 200 toward the drawer-side positioning portion 141B. Such a configuration contributes to improving the positional accuracy of the positioning surface (surface made to abut the drawer-side positioning portion 141B) of the main body-side positioning portion 230, compared with a configuration in which, for example, the entirety of the periphery of the opening of the duct is formed as the positioning portion.

Further, the positioning portions 141B, 230 are formed in a prolonged shape in the front-back direction (moving direction of the drawer 45). Such a configuration enables a dimensional error in the moving direction of the drawer 45 to be absorbed, thereby assuring that the positioning portions 141B, 230 contact each other without fail and thus successfully achieving the positioning between the ducts 140, 200, even though the position of the drawer 45 in the front-back direction is shifted because of an error.

In addition, as shown in FIG. 6A, a plurality of drawer-side electrodes 45B, 45C (see FIG. 3) exemplifying the unit-side electrode are provided on the sidewall 45A on the right of the drawer 45 (the same side as the drawer-side positioning portion 141B in the left-right direction). On the other hand, main body-side electrodes 23B, 23C are provided, to make contact with the drawer-side electrodes 45B, 45C, on the sidewall 23 on the right of the apparatus main body 2 (the same side as the main body-side positioning portion 230 in the left-right direction) as shown in FIG. 6B.

Such a configuration assures that the drawer-side electrodes 45B, 45C and the main body-side electrodes 23B, 23C can be securely made to contact, with the urging force of the driving force transmission unit 60 to be subsequently described.

Figure 7:
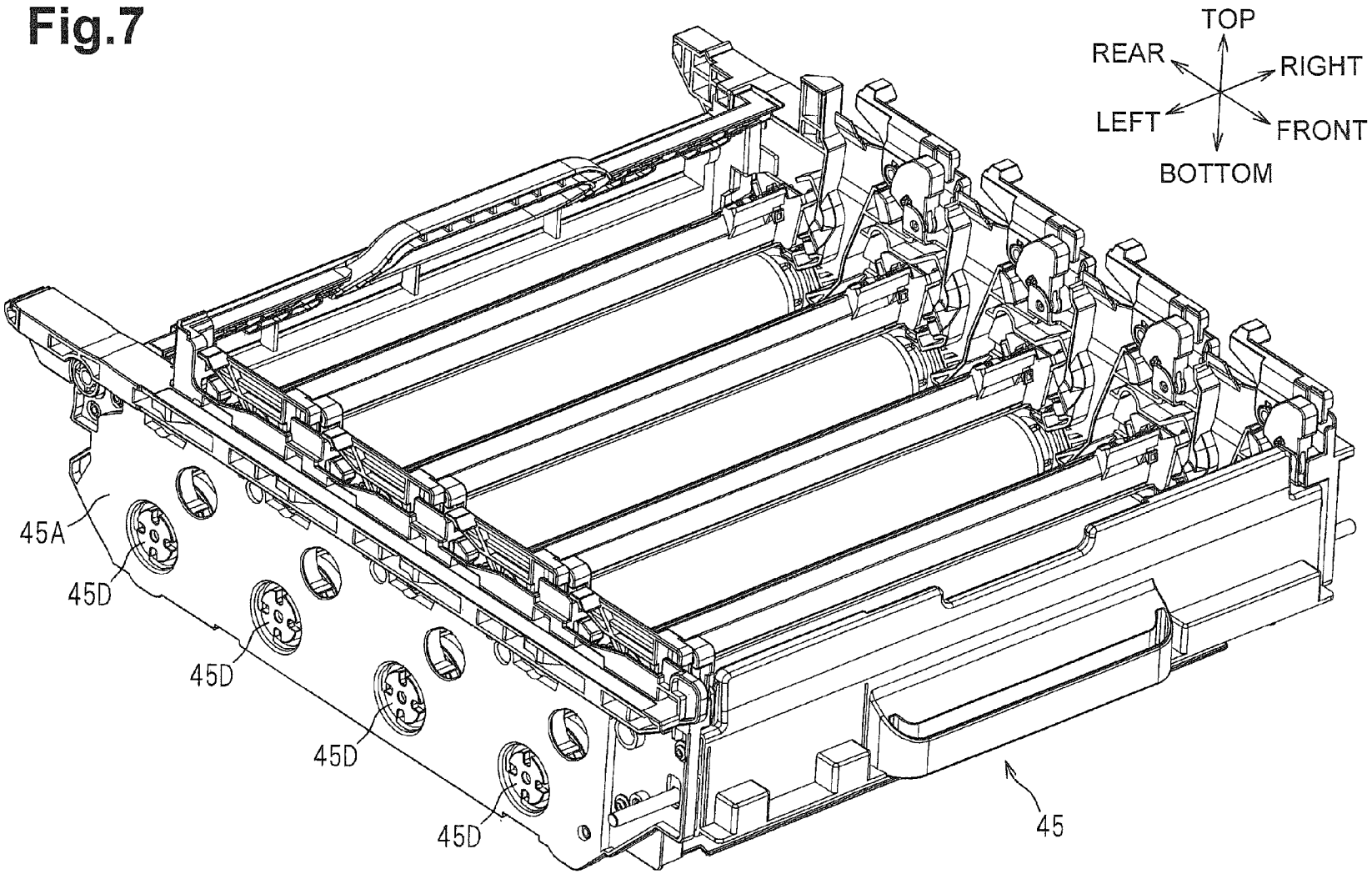
FIG. 7 is a perspective view of the drawer viewed from the left.
Figure 8:
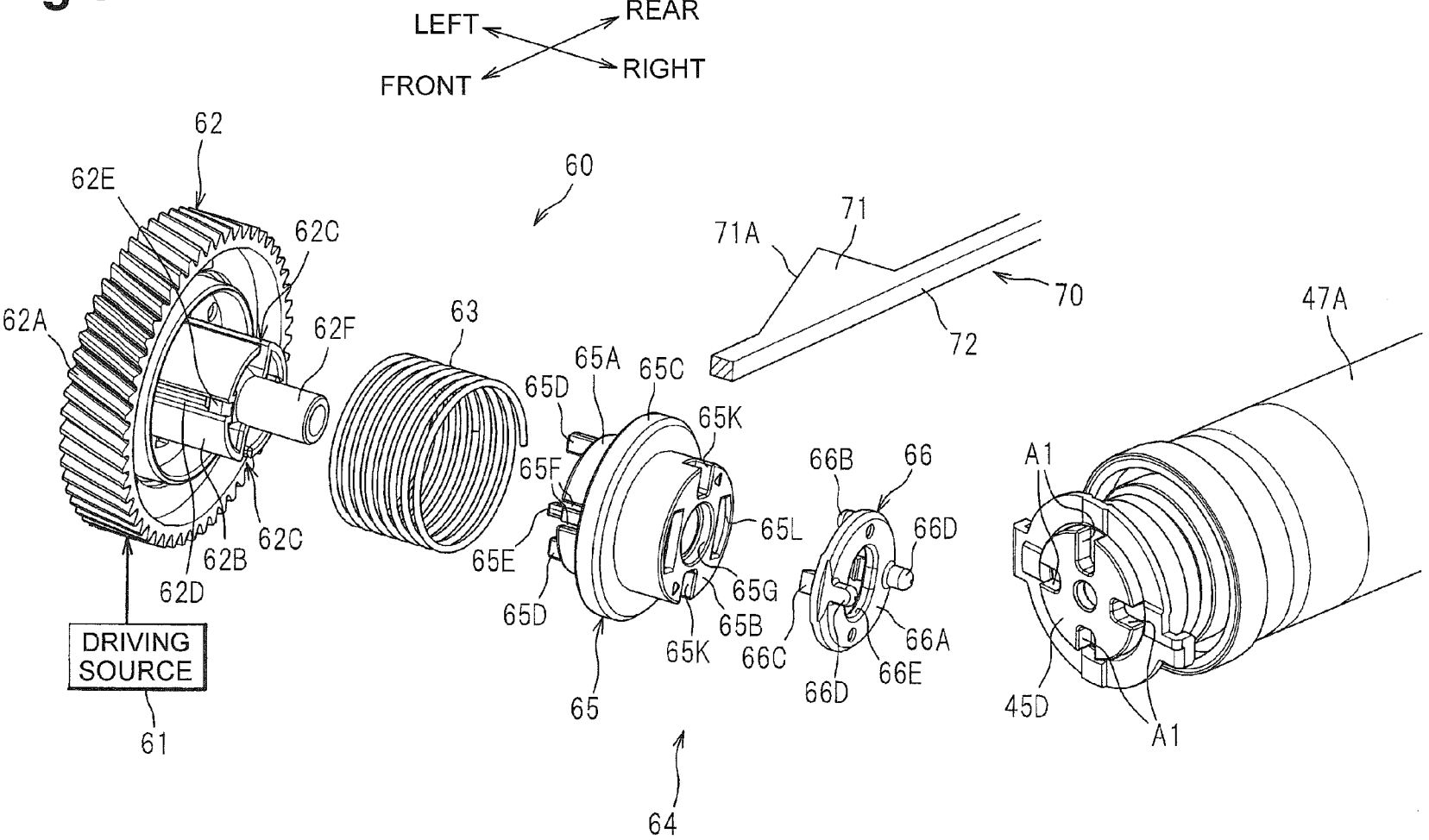
FIG. 8 is an exploded perspective view of a driving force transmission unit.

Referring to FIGS. 7 and 8, a drawer-side coupling 45D exemplifying the driving force supplier (unit-side coupling) is provided on the sidewall 45A on the left of the drawer 45, and the driving force transmission unit 60 is provided on the sidewall (not shown) on the left of the apparatus main body 2. In FIG. 8, the photo conductor 47A is illustrated in an angle different from the actual state for the sake of convenience, so that the drawer-side coupling 45D can be seen.

The drawer-side coupling 45D is fixed on the end face of each of the four photo conductors 47A rotatably mounted in the drawer 45. Four driving force transmission units 60 (only one is shown) are provided between the drawer 45 located at the inner position and the apparatus main body 2, so as to oppose the respective drawer-side couplings 45D.

The driving force transmission unit 60 transmits the driving force while applying the urging force to the drawer-side coupling 45D so as to move to the right (toward the main body-side positioning portion). Accordingly, as already described, the drawer 45 is urged to the right so that the positioning portions 141B, 230 make contact with each other, while the driving force transmission unit 60 is transmitting the driving force to the drawer-side coupling 45D.

Utilizing thus the driving force transmission unit 60 to urge the drawer 45 eliminates the need to provide exclusive parts for urging the drawer 45, such as a spring, thereby contributing to reducing the cost.

More specifically, the driving force transmission unit 60 includes a driving source 61 such as a motor, a main body driving gear 62, a coil spring 63 exemplifying the elastic member, and a main body-side coupling 64. The driving source 61 is located at an appropriate position in the apparatus main body 2, and serve to transmit, directly or indirectly by means of a gear, the driving force to the main body driving gear 62.

The main body driving gear 62 is rotatably mounted in the apparatus main body 2, and essentially includes a gear teeth portion 62A that transmits the driving force 61 from the driving source 61, and a projecting portion 62B formed so as to stick out from a central portion of the gear teeth portion 62A toward the main body-side coupling 64. A pair of first recessed portions 62C are formed on the outer circumferential surface of the projecting portion 62B at opposite positions across the rotational axis, in the axial direction of the main body driving gear 62. In addition, a pair of engaging recesses 62D are formed on the outer circumferential surface of the projecting portion 62B, between the pair of first recessed portions 62C (spaced in the rotating direction generally by 90 degrees).

Figure 9A:
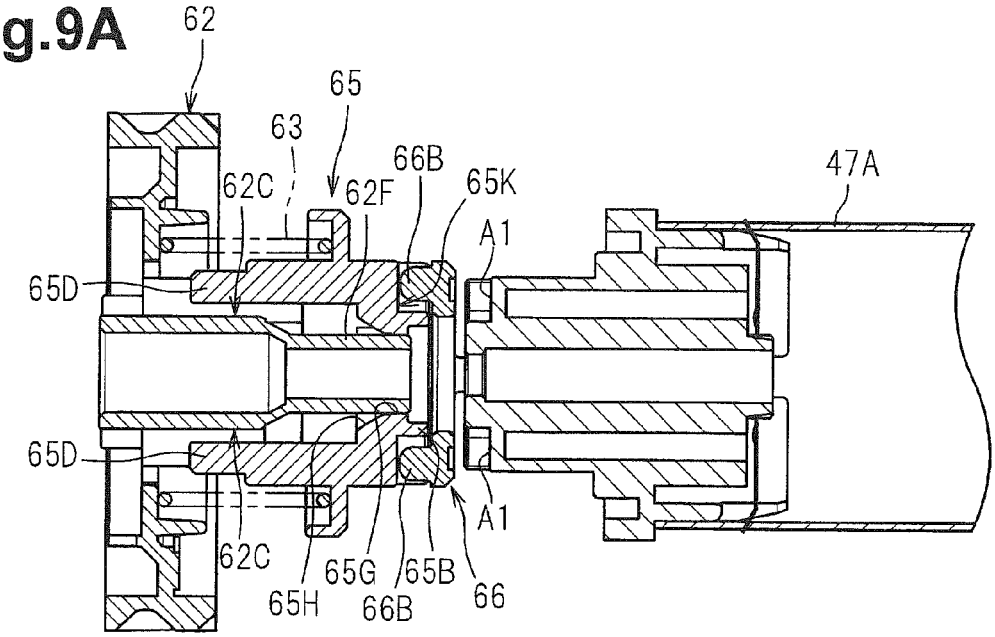
FIGS. 9A and 9B are cross-sectional views of the driving force transmission unit, taken along a first radial direction and taken along a second radial direction, respectively.
Figure 9B:
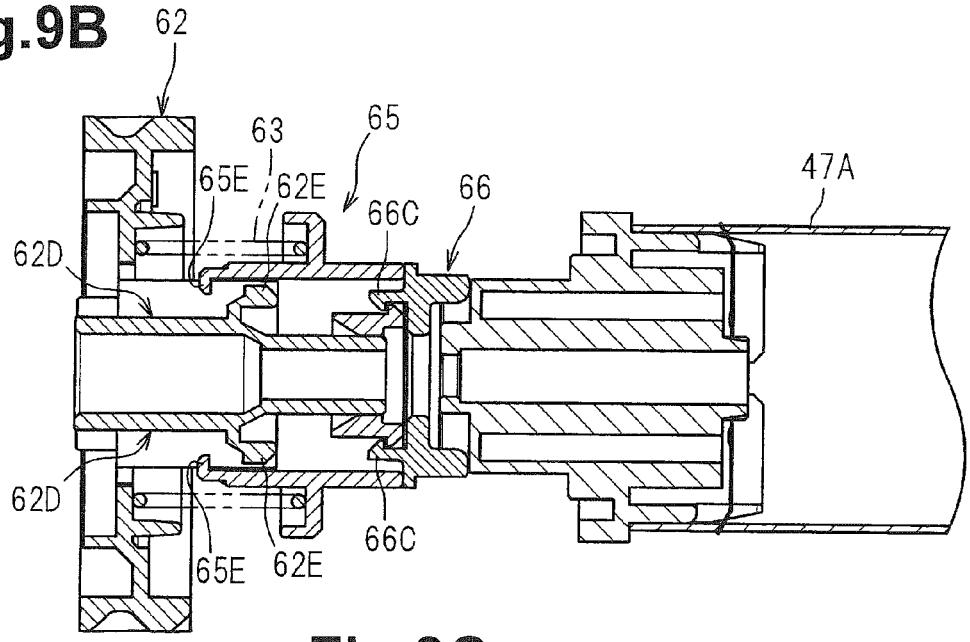

In addition, an engaging rib 62E is formed on the end portion of each engaging recess 62D on the side of the main body-side coupling 64, so as to protrude outward in the radial direction of the main body driving gear 62 (see FIG. 9B). On the leading end portion of the projecting portion 62B, a cylindrical extended portion 62F having a smaller diameter than the projecting portion 62B is formed so as to project in the axial direction.

The coil spring 63 is provided between the main body driving gear 62 and the main body-side coupling 64 (more particularly, coupling member 65 to be subsequently described), and serves to urge the main body driving gear 62 and the main body-side coupling 64 so as to move away from each other.

The main body-side coupling 64 is provided between the main body driving gear 62 and the drawer-side coupling 45D, to be engaged with the main body driving gear 62 and the drawer-side coupling 45D in the rotating direction, to thereby transmit the driving force from the main body driving gear 62 to the drawer-side coupling 45D. The main body-side coupling 64 is supported by the main body driving gear 62 so as to move back and forth in the axial direction, so that the main body-side coupling 64 and the drawer-side coupling 45D can be connected to and separated from each other.

More specifically, the main body-side coupling 64 includes a coupling member 65 located on the side of the main body driving gear 62 and an Oldham member 66 located on the side of the drawer-side coupling 45D.

The coupling member 65 is supported by the main body driving gear 62 so as to move in the axial direction and engaged therewith in the rotating direction, and essentially includes a cylindrical portion 65A to which the projecting portion 62B of the main body driving gear 62 is fitted, and a wall portion 65B that covers the end portion of the cylindrical portion 65A on the side of the Oldham member 66, so as to oppose the Oldham member 66.

An annular flange 65C is formed on the outer circumferential surface of the cylindrical portion 65A so as to outwardly protrude in the radial direction. The coil spring 63 serves to urge the annular flange 65C and the gear teeth portion 62A of the main body driving gear 62 so as to move away from each other.

A pair of first protruding portions 65D are provided on the inner circumferential surface of the cylindrical portion 65A, at opposite positions across the rotational axis. The first protruding portions 65D become engaged with the first recessed portion 62C of the main body driving gear 62 upon intruding thereinto, in the rotating direction and so as to relatively move in the axial direction with respect to the first recessed portion 62C.

A pair of engaging nails 65E are provided on the cylindrical portion 65A between the pair of first protruding portions 65D (spaced in the rotating direction generally by 90 degrees) (see FIG. 9B). The engaging nail 65E sticks out from the inner circumferential surface of the cylindrical portion 65A so as to be fitted with the engaging recess 62D of the main body driving gear 62, thus to be engaged with the engaging rib 62E in the axial direction.

In addition, a pair of slits 65F are formed on the respective sides of each engaging nail 65E, so as to axially extend all the way to the end portion of the cylindrical portion 65A. Thus, when the cylindrical portion 65A of the coupling member 65 is to be fitted with the projecting portion 62B of the main body driving gear 62, the engaging nail 65E becomes engaged with the engaging rib 62E in the axial direction upon passing over the engaging rib 62E by effectively being deflected. Such engagement between the engaging nail 65E and the engaging rib 62E restricts the coupling member 65 from moving toward the photo conductor 47A, to thereby prevent the coupling member 65 from being disengaged from the main body driving gear 62.

Figure 9C:
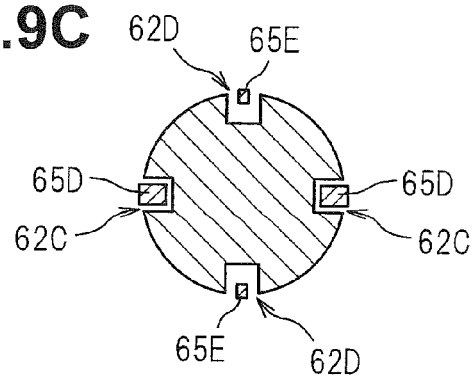
FIG. 9C is a schematic cross-sectional view for explaining a relationship between an engaging nail and an engaging recess, and between a first protruding portion and a first recessed portion.

Further, the engaging nail 65E is, as schematically illustrated in FIG. 9C, formed in a smaller size in projecting length and width than the first protruding portion 65D (protruding portion not configured as the engaging nail), and hence located farther away from the surface of the recessed portion (engaging recess 62D) than the first protruding portion 65D. Accordingly, when the cylindrical portion 65A of the coupling member 65 relatively moves in the radial direction or rotating direction with respect to the projecting portion 62B of the main body driving gear 62, the first protruding portion 65D not serving as the engaging nail contacts the first recessed portion 62C, before the engaging nail 65E contacts the engaging recess 62D. As a result, the engaging nail 65E is prevented from being broken because of the contact with the engaging recess 62D, by the engagement between the first protruding portion 65D and the first recessed portion 62C.

As shown in FIG. 8, a circular bore 65G is formed in the central portion of the wall portion 65B, in which the extended portion 62F of the main body driving gear 62 is to be fitted. Because of such a configuration, the bore 65G located on one end portion and the first protruding portion 65D on the other end portion in the axial direction, i.e., the both end portions of the coupling member 65 is supported by the main body driving gear 62, and therefore the coupling member 65 can be stably moved in the axial direction.

More specifically, the bore 65G is formed in a cylindrical shape extending in the axial direction as shown in FIG. 9A. Therefore the extended portion 62F and the bore 65G establish a plane-to-plane contact with each other, which further contributes to stabilizing the axial movement of the coupling member 65.

On the end portion of the bore 65G on the side of the main body driving gear 62, a tapered surface 65H is formed such that the diameter gradually decreases in a direction from the main body driving gear 62 toward the Oldham member 66. Such a configuration allows the extended portion 62F to be guided along the tapered surface 65H thus to be smoothly fitted with the bore 65G upon pressing the coupling member 65 toward the main body driving gear 62, even when the coupling member 65 moves away from the main body driving gear 62 to a position where the bore 65G is about to come off from the extended portion 62F, and becomes radially deviated with respect to the main body driving gear 62.

As shown in FIG. 8, the wall portion 65B includes a pair of second recessed portions 65K and a pair of slots 65L.

The pair of second recessed portions 65K are located so as to oppose in the radial direction across the bore 65G, and each formed as a groove having a width increasing along the opposing direction (hereinafter, first radial direction). In the respective second recessed portions 65K, a pair of second protruding portions 66B formed on the Oldham member 66 to be subsequently described are to be each fitted so as to move in the first radial direction and to be engaged in the rotating direction (see FIG. 9A).

The pair of slots 65L are located so as to oppose across the bore 65G, in the radial direction orthogonal to the first radial direction (hereinafter, second radial direction), and formed as a through hole oriented such that the longitudinal direction thereof is aligned with the first radial direction. A pair of flexibly deformable hook portions 66C formed on the Oldham member 66 to be subsequently described are to be respectively engaged with the inner edge of the slot 65L, so as to move in the first radial direction and to be engaged in the axial direction. With such configuration, the Oldham member 66 can be attached to the coupling member 65 so as to move in the axial direction together with the coupling member 65, and to move in the first radial direction with respect to the coupling member 65.

The Oldham member 66 essentially includes a disk-shaped base portion 66A, the pair of second protruding portions 66B and the pair of hook portions 66C provided on the surface of the base portion 66A on the side of the coupling member 65, and a pair of third protruding portions 66D provided on the surface of the base portion 66A on the side of the drawer-side coupling 45D.

A slot 66E is formed along the first radial direction in the central portion of the base portion 66A. Such a configuration prevents interference between the extended portion 62F of the main body driving gear 62 and the Oldham member 66, even when the Oldham member 66 is deviated in the first radial direction with respect to the coupling member 65 and the main body-side coupling 64 moves closer to the main body driving gear 62.

The pair of second protruding portions 66B are located so as to oppose in the first radial direction across the slot 66E, and engaged with the pair of second recessed portions 65K of the coupling member 65 as stated above. The second protruding portions 66B each have the tip portion formed in a semi-spherical shape, so that the second protruding portion 66B can be smoothly fitted with the second recessed portion 65K when the Oldham member 66 is to be attached to the coupling member 65.

The pair of hook portions 66C are hook-shaped projections extending in the axial direction toward the coupling member 65 and then inwardly bent in the radial direction. The pair of hook portions 66C are located so as to oppose in the second radial direction across the slot 66E, and engaged with the pair of slots 65L of the coupling member 65 as stated above.

The pair of third protruding portions 66D are located so as to oppose in the second radial direction across the slot 66E. On the other hand, four third recessed portions A1 are formed on the end face of the drawer-side coupling 45D in a slit shape in the radial direction, at intervals of generally 90 degrees so as to surround the rotation axis of the photo conductor 47A. Accordingly, when the pair of third protruding portions 66D are fitted in a corresponding pair of third recessed portions A1 among the four of them, the Oldham member 66 can be engaged with the drawer-side coupling 45D in the rotating direction so as to move in the second radial direction.

The third protruding portion 66D each have the tip portion formed in a semispherical shape. Accordingly, the third protruding portion 66D can be smoothly fitted with the third recessed portion A1.

Further, the apparatus main body 2 includes a removal mechanism 70 that pushes the main body-side coupling 64 (more particularly, coupling member 65) toward the main body driving gear 62 so as to remove the main body-side coupling 64 from the drawer-side coupling 45D. The removal mechanism 70 includes four cams 71 (only one is shown) and arms 72 that each support the cam 71, and the arm 72 is made to move back and forth by an opening and closing action of the front cover 21.

The cams 71 each include a sloped surface 71A inclined to the left in the backward direction, and the sloped surface 71A is disposed so as to contact the annular flange 65C of the coupling member 65 in the front-back direction.

Accordingly, when the user opens the front cover 21, the cams 71 are made to move forward by the opening motion of the front cover 21, so that the sloped surface 71A of the cam 71 pushes the annular flange 65C of the coupling member 65 against the urging force of the coil spring 63, and as a result the main body-side coupling 64 is removed from the drawer-side coupling 45D, so that the drawer 45 can be drawn out.

Conversely, when the drawer 45 is moved to the inner position from the outer position thus to be mounted in the apparatus main body 2, the drawer-side couplings 45D of the drawer 45 now set at the inner position are located so as to oppose the main body-side couplings 64 in the axial direction. Upon closing the front cover 21 at this stage, the main body-side couplings 64 thus far pressed by the corresponding cam 71 are caused to move to the right by the urging force of the coil spring 63, thus to be connected to (urged toward) the corresponding drawer-side coupling 45D.

In this process, although the central axis of the drawer-side coupling 45D (photo conductor 47A) and that of the main body driving gear 62 are not aligned, the Oldham member 66 is movable in the first radial direction as well as in the second radial direction orthogonal thereto, upon being engaged with the drawer-side coupling 45D and the coupling member 65 in the rotating direction. Therefore, the Oldham member 66 can transmit the driving force to the drawer-side coupling 45D and the main body driving gear 62 while making a sliding movement, as if it were an Oldham's coupling. Consequently, the driving force can be effectively transmitted from the main body driving gear 62 to the drawer-side coupling 45D (photo conductor 47A) through the main body-side coupling 64.

In addition to the foregoing advantageous effects, this embodiment provides the following advantages.

Since the drawer-side duct 140 is provided on the frame 110 of the charger 100 as a unified part, the joint between the drawer-side duct 140 and the frame 110 can be omitted and a sufficient amount of air can be supplied into the charger 100, unlike a configuration in which the drawer-side duct and the frame of the charger are separately formed.

The present invention is in no way limited to the foregoing embodiment, but may be modified in various manners, some examples of which are described here below. In the following description, the components that are generally the same as those of the embodiment will be given the same numeral, and the description thereof will not be repeated.

Figure 10:
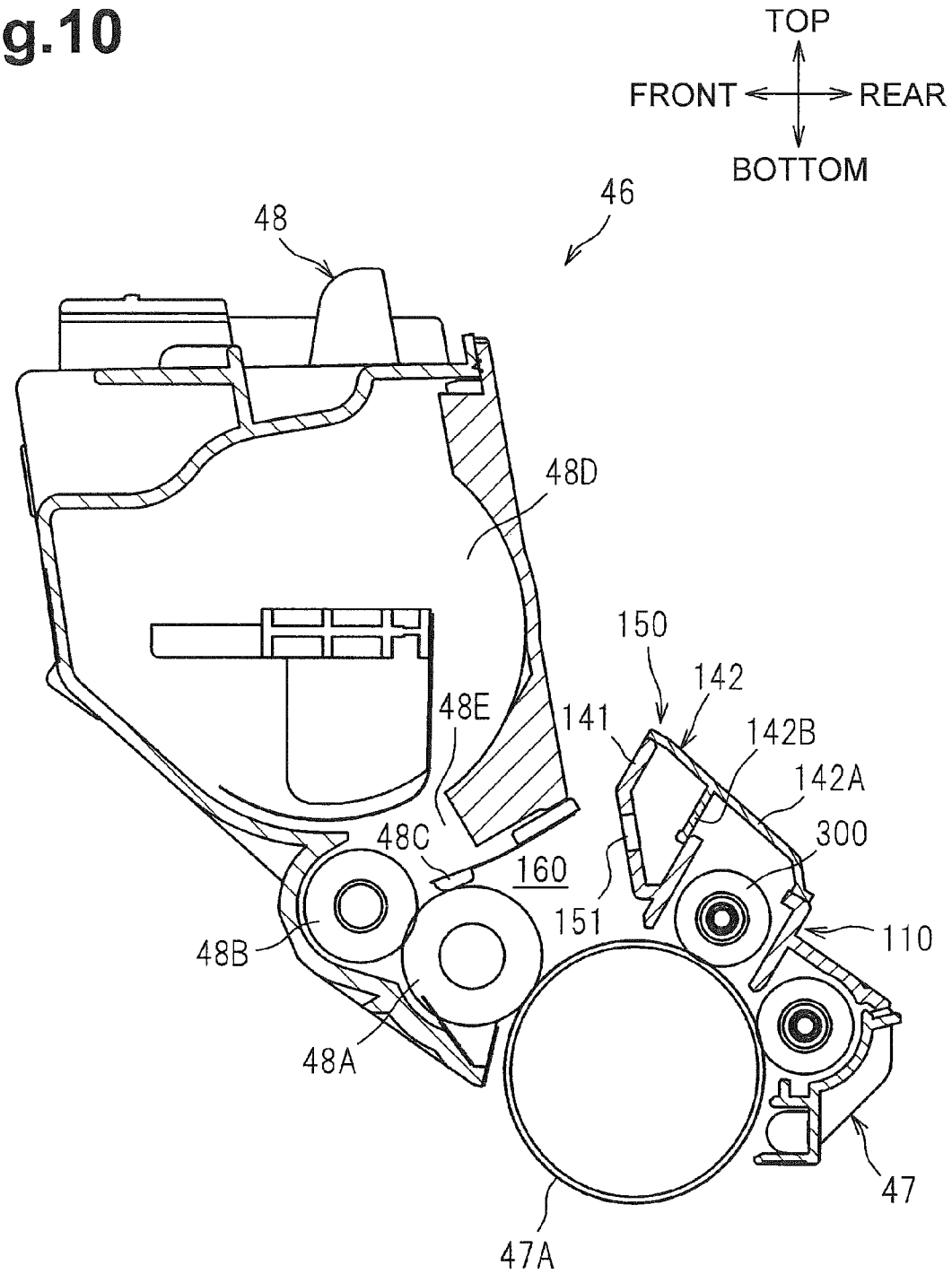
FIG. 10 is a cross-sectional view of a variation of the drawer-side duct.

Although the communication member (drawer-side duct 140) is set to communicate with inside of the frame 110 of the charger 100 according to the embodiment, a drawer-side duct 150 may be provided, for example as shown in FIG. 10, so as to communicate with a space 160 adjacent to the developing cartridge 48.

More specifically, a drawer-side duct 150 shown in FIG. 10 includes the duct portion 141 and the cover member 142 that are generally the same as those of the embodiment. In the drawer-side duct 150, a ventilation hole 151 is provided in the duct portion 141, instead of forming the ventilation hole 142C in the partition portion 142B of the cover member 142 as in the embodiment.

In this case, a sufficient amount of air can be supplied to the space 160 adjacent to the developing cartridge 48, where heat is generated because of the sliding contact between the developing roller 48A and the thickness delimiting blade 48C, and hence the developing cartridge 48 can be effectively cooled. Here, in the case where the ventilation hole 142C is not provided in the partition portion 142B of the cover member 142 as the configuration shown in FIG. 10, the flow path for the ionic wind cannot be secured. Therefore, it is preferable to provide a charging roller 300 that charges the photo conductor 47A by making contact therewith, instead of the corona-discharge type charger 100 employed in the embodiment.

In the configuration shown in FIG. 10 the drawer-side duct 150 communicates with the space 160 adjacent to the developing cartridge 48, however in the case where, for example, a developing unit including a developing chamber and a toner cartridge including a toner chamber are separately provided, the drawer-side duct may be set to communicate with a space adjacent to the developing unit.

Although the drawer-side positioning portion 141B (unit-side positioning portion) and the main body-side positioning portion 230 are both formed in a shape prolonged in the front-back direction (moving direction) in the embodiment, it suffices that at least one of the unit-side positioning portion and the main body-side positioning portion be formed in a prolonged shape.

Although the drawer 45 is adopted as an example of the module unit in the embodiment, the present invention is broadly applicable to any unit, as far as the unit includes components for forming an image on a recording sheet and is movable between an inner position and an outer position with respect to the apparatus main body. The module unit may be, for example, a drum cartridge that includes a photo conductor capable of forming an image on a recording sheet and that can be removably mounted in an apparatus main body, in the case where the apparatus is a monochrome printer. In this case, the module unit may also be a processing cartridge integrally composed of the drum cartridge and the developing cartridge.

The communication member is exemplified by the drawer-side duct 140 unified with the frame 110 of the charger 100 in the embodiment. Instead, for example, the sidewall of the drawer may be utilized as the communication member in the case where an orifice is formed in the sidewall of the drawer so as to supply external air therethrough to the space around the developing unit.

Although the communication member and the ventilation member are composed of two components in the embodiment, these members may be composed of a single component, or three or more components.

Although the urging member is exemplified by the driving force transmission unit 60 in the embodiment, alternatively a spring, such as a coil spring or a leaf spring may be employed. In addition, the driving force transmission unit may be configured so as to generate a urging force that pulls the drawer (for example, see Japanese Unexamined Patent Application Publication Nos. 2003-148503 and 2003-186348), instead of generating a urging force that pushes the drawer 45 according to the embodiment.

The driving force supplier and the driving force transmission unit may be composed of, for example, helical gears instead of the configuration according to the embodiment. More specifically, for example a drum-side helical gear provided at an end portion of the photo conductor and a main body-side helical gear provided on the apparatus main body may be meshed so as to apply a thrust power that urges the drawer when the gears are driven.

Although the elastic member is exemplified by the coil spring 63 in the embodiment, for example a leaf spring or a torsion spring may be employed instead.

Although the photoreceptor is exemplified by the photo conductor 47A in the embodiment, for example a belt-shaped photoreceptor may be employed instead.

Although the present invention is applied to the color laser printer 1 in the embodiment, the present invention is broadly applicable to other types of image forming apparatuses, such as a copier and a multifunction printer.

What is claimed is:

1. An image forming apparatus comprising:

an apparatus main body; and a module unit including image formation components, the module unit being movable along a predetermined moving direction between an inner position inside the apparatus main body and an outer position wherein at least a portion of the module unit is outside of the apparatus main body, wherein the module unit includes:

a communication member having an opening that allows communication between an inside and an outside of the module unit;

a unit-side positioning portion adjacent to the opening of the communication member, and wherein the apparatus main body includes:

a ventilation member having an opening, the opening of the ventilation member opposing the opening of the communication member of the module unit located at the inner position, the ventilation member forming an air flow path together with the communication member;

a main body-side positioning portion adjacent to the opening of the ventilation member, and a spring configured to urge the unit-side positioning portion of the module unit into contact with the main body-side positioning portion in an urging direction perpendicular to the predetermined moving direction, the spring being provided between the module unit and the apparatus main body in the urging direction when the module unit is located at the inner position.

2. The image forming apparatus according to claim 1, wherein the unit-side positioning portion protrudes from a peripheral part of the opening of the communication member toward the main body-side positioning portion.

3. The image forming apparatus according to claim 1, wherein the module unit further comprises a driving force input member, wherein the spring is included in a driving force transmission unit configured to transmit a driving force to rotate the driving force input member, and to urge the driving force input member toward the main body side positioning portion in the urging direction, and wherein the driving force input member is configured to rotate a photoconductive roller.

4. The image forming apparatus according to claim 3, wherein the module unit includes a first side and a second side spaced from the first side with respect to a direction orthogonal to the moving direction of the module unit, wherein the opening of the communication member and the unit-side positioning portion are provided on the first side of the module unit, and the opening of the ventilation member and the main body-side positioning portion are provided on the first side of the module unit when the module unit is at the inner position, and wherein the driving force input member is provided on the second side of the module unit, and the driving force transmission unit is provided at the second side of the module unit when the module unit is at the inner position.

5. The image forming apparatus according to claim 4, wherein the driving force input member includes a unit-side coupling rotatably mounted on the module unit, wherein the driving force transmission unit includes a main body side coupling, and wherein the spring is configured to urge the main body side coupling toward the unit side coupling, wherein the main body side coupling is rotatably mounted on the apparatus main body, and configured to engage with, and rotate the unit side coupling, and also configured to move back and forth in an axial direction of the main body side coupling.

6. The image forming apparatus according to any of claim 1, wherein the module unit includes a charger for charging a photoreceptor that utilizes corona discharge, and wherein the communication member is disposed to communicate with an inside of a frame of the charger.

7. The image forming apparatus according to claim 6, wherein the communication member is integral with the frame of the charger.

8. The image forming apparatus according to claim 1, wherein the module unit further includes:

a developing unit which includes:

a developing roller for supplying a developing agent to a photoreceptor; and a slide-contact member disposed in sliding contact the developing roller, and wherein the communication member includes another opening which faces the developing unit.

9. The image forming apparatus according to claim 1, wherein at least one of the unit-side positioning portion and the main body-side positioning portion is formed in a shape elongated in the moving direction of the module unit.

10. The image forming apparatus according to claim 4, wherein the module unit includes a unit-side electrode located at the first side of the module unit, and wherein the apparatus main body includes a main body-side electrode located at the first side of the module unit and contacting the unit-side electrode when the module unit is at the inner position.

11. The image forming apparatus according to claim 1, wherein the module unit includes a drawer including:

a pair of sidewalls configured to support a plurality of photoreceptors, and the drawer configured to receive a plurality of developing cartridges which supply a developing agent to the photoreceptors.

12. The image forming apparatus according to claim 11, wherein the photoreceptors are positioned between the pair of sidewalls and each include a first axial end configured to engage with one of the sidewalls of the pair of sidewalls.

13. An image forming apparatus comprising:

an apparatus main body; and a module unit movable along a first direction between an inner position inside the apparatus main body and an outer position wherein at least a portion of the module unit is outside of the apparatus main body, the module unit including a first side and a second side that is an opposite side of the first side in a second direction perpendicular to the first direction, wherein the module unit includes:

a communication member having a communication portion located at the first side of the module unit and allows communication between an inside and an outside of the module unit; and a unit-side positioning portion located at the first side of the module unit, and wherein the apparatus main body includes:

a ventilation member having a ventilation portion, the ventilation portion opposing the communication portion and located to communicate with the communication portion when the module unit is located at the inner position, the ventilation member forming an air flow path together with the communication portion;

a main body-side positioning portion opposing the unit side positioning portion of the module unit located at the inner position; and a spring configured to urge, in the second direction, the unit-side positioning portion of the module unit into contact with the main body-side positioning portion, the spring provided between the module unit and the apparatus main body in the second direction when the module unit is located at the inner position.

14. The image forming apparatus according to claim 13, wherein the communication portion includes an opening.

15. The image forming apparatus according to claim 13, wherein the module unit further comprises a driving force input member, and wherein the spring is included in a driving force transmission unit configured to transmit a driving force to the driving force input member, and to urge the driving force input member and bring the unit-side positioning portion into contact with the main body-side positioning portion.

16. The image forming apparatus according to claim 15, wherein the driving force input member includes a coupling mounted on the module unit, and wherein the driving force transmission unit includes a coupling mounted on the main body.

17. The image forming apparatus according to claim 16, wherein the driving force transmission unit further comprises an elastic member configured to urge the coupling mounted on the main body toward the coupling mounted on the module unit thereby bringing the unit-side positioning portion into contact with the main body-side positioning portion.

18. The image forming apparatus according to claim 13, wherein the module unit includes a charger that utilizes corona discharge for charging a photoreceptor, the charger including a housing, and wherein the communication member is disposed to communicate with an inside of the housing of the charger.

19. The image forming apparatus according to claim 18, wherein the communication member is integral with the housing of the charger.

20. The image forming apparatus according to claim 18, wherein the module unit includes:

a developing unit which includes:

a developing roller for supplying a developing agent to the photoreceptor; and a slide-contact member disposed in sliding contact with the developing roller, and wherein the communication member includes an opening which faces the developing unit.

21. The image forming apparatus according to claim 13, wherein at least one of the unit-side positioning portion and the main body-side positioning portion is formed in a shape elongated in the first direction.

22. An image forming apparatus comprising:

an apparatus main body; and a module unit including image formation components, the module unit being movable between an inner position inside the apparatus main body and an outer position that is more exterior to the apparatus main body than the inner position, along a predetermined moving direction, wherein the module unit includes:

a module unit body configured to receive a cartridge, and which includes:

a communication member having an opening that allows communication between an inside and an outside of the module unit; and a unit-side positioning portion located adjacent to the opening of the communication member; and wherein the apparatus main body includes:

a ventilation member having an opening, the opening of the ventilation member opposing the opening of the communication member of the module unit located at the inner position, the ventilation member forming an air flow path together with the communication member;

a main body-side positioning portion adjacent to the opening of the ventilation member; and a spring configured to urge the unit-side positioning portion of the module unit body into contact with the main body-side positioning portion in a direction orthogonal to the predetermined moving direction, the spring being provided between the module unit and the apparatus main body, in the direction orthogonal to the predetermined moving direction, when the module unit is located at the inner position.

23. The image forming apparatus of claim 22, wherein an urging member, including the spring, is configured to contact the module unit body to thereby urge the module unit body and bring the unit-side positioning portion into contact with the main body-side positioning portion.

24. The image forming apparatus of claim 1, wherein the spring remains stationary relative to the apparatus main body in the predetermined moving direction of the module unit when the module unit moves between the inner position and the outer position.

* * * * *